US006164764A

United States Patent [19]

Takada

[11] Patent Number: 6,164,764

[45] Date of Patent: Dec. 26, 2000

[54] SOLID-STATE ACTUATOR AND INK JET HEAD

[75] Inventor: Akihiko Takada, Toyko, Japan

[73] Assignee: NEC Corporation, Tokyo, Japan

[21] Appl. No.: 09/161,412

[22] Filed: Sep. 24, 1998

[30] Foreign Application Priority Data

Sep. 25, 1997 [JP] Japan ..... 9-259954

[51] Int. Cl.[7] ..... B41J 2/045

[52] U.S. Cl. ..... 347/71

[58] Field of Search ..... 347/68, 70, 71

[56] References Cited

U.S. PATENT DOCUMENTS

| | | | |
|---|---|---|---|
| 5,305,507 | 4/1994 | Dvorsky et al. | 29/25.35 |
| 5,379,060 | 1/1995 | Yoshimura | 347/71 |
| 5,471,231 | 11/1995 | Hiraishi et al. | 347/68 |
| 5,696,545 | 12/1997 | Ochiai et al. | 347/71 |
| 5,754,205 | 5/1998 | Miayata et al. | 347/70 |
| 5,894,651 | 4/1999 | Dvorsky et al. | 310/344 |

FOREIGN PATENT DOCUMENTS

| | | |
|---|---|---|
| 4-283975 | 10/1992 | Japan . |
| 4-343594 | 11/1992 | Japan . |
| 5-243102 | 9/1993 | Japan . |
| 6-249706 | 9/1994 | Japan . |
| 6-297712 | 10/1994 | Japan . |

*Primary Examiner*—John Barlow
*Assistant Examiner*—Craig A. Hallacher
*Attorney, Agent, or Firm*—Foley & Lardner

[57] ABSTRACT

A solid-state actuator includes an actuator main body, an electrode, and an insulating film. The actuator main body deforms in response to reception of a voltage. The electrode is made of a conductive material and is formed on a surface of the actuator main body to apply the voltage. The insulating film is formed on a surface of the electrode.

6 Claims, 3 Drawing Sheets

SOLID-STATE ACTUATOR AND INK JET HEAD

BACKGROUND OF THE INVENTION

The present invention relates to a solid-state actuator which deforms upon reception of a voltage and, more particularly, to an ink jet head which injects ink using deformation of the solid-state actuator.

Generally, in an ink jet head of this type, a base plate is formed by a solid-state actuator which deforms in response to reception of a voltage. A plurality of ink chambers with nozzle holes are formed in this base plate. When a voltage is applied, the base plate deforms to expand/contract the ink chambers, and ink is injected from the nozzle holes.

FIG. 4 shows an ink jet head disclosed in U.S. Pat. No. 5,471,231. In FIG. 4, grooves are formed in the upper surface of a base plate 2 consisting of a piezoelectric material to form long groove-like channels 61 to 65 partitioned by partition walls 31 to 36. Electrodes 41 to 45 of a conductive material are formed on the inner walls and bottom surfaces of the channels 61 to 65, respectively. A nozzle plate forming one end face of each of the channels 62 and 64 along the longitudinal direction has nozzle holes 52 and 54. The channels 62 and 64 serve as ink channels while the channels 61, 63, and 65 are dummy channels.

The upper opening portions of the channels 61 to 65 are covered with a cover 4 fixed to the base plate 2 with adhesive portions 5. Each of the ink channels 62 and 64 forms an ink chamber together with the cover 4 and the nozzle plate. The other end face of each of the ink channels 62 and 64 constituting the ink chambers along the longitudinal direction is connected to a common ink reservoir (not shown), so the ink channels 62 and 64 are filled with ink.

In this arrangement, in the partition walls 32 to 35 on both sides of the ink channels 62 and 64, polarizations 91 are formed in advance toward the ink channels in the direction of thickness of partition walls. In addition, a polarization 92 is formed in the base plate 2 in the direction of thickness toward the ink channels in advance.

When a negative potential with respect to that at the electrodes 41 and 43 is applied to the electrode 42, the partition walls 32 and 33 deform in the expansion/contraction mode due to interaction between lines of electric force 81 and the polarization 91. The width and height of the ink channel 62 reduce in accordance with deformation of the partition walls 32 and 33. Since the sectional area of the ink channel 62 reduces, an ink droplet is ejected from the nozzle hole 52. The bottom portion of the ink channel 62 of the base plate 2 also deforms in the expansion/contraction mode due to interaction between lines of electric force 82 and the polarization 92, so the channel bottom portion becomes narrow.

As described above, the ink droplet ejection performance is determined by deformation of the partition walls 32 to 35 and the bottom portions of the ink channels 62 and 64. The same operation as described above is also performed in the ink channel 64 and the partition walls 34 and 35.

In the above-described conventional ink jet head, ink is selectively ejected from the nozzle hole 52 while ink ejection from the nozzle hole 54 is stopped in accordance with the print pattern. In this case, a negative potential with respect to that at the electrodes 41 and 43 is applied to the electrode 42 while the same potential as that at the electrodes 43 and 45 is applied to the electrode 44. For this reason, the electrode 42 has a negative potential with respect to the electrode 44.

The ink channels 62 and 64 are connected to the common ink reservoir (not shown), as described above. With this arrangement, an electric field is generated through a route: ink channel 64→ink reservoir→ink channel 62, and the current leaks. If this potential is continuously applied, the ink is electrolyzed at the electrodes 42 and 44 to form bubbles. When the ink chambers 62 and 64 are filled with bubbles, ink ejection from the nozzle holes 52 and 54 is impeded.

SUMMARY OF THE INVENTION

It is an object of the present invention to provide a solid-state actuator which prevents an operation disabled state.

It is another object of the present invention to provide an ink jet head which prevents an ink ejection disabled state to improve quality.

In order to achieve the above objects, according to the present invention, there is provided a solid-state actuator comprising an actuator main body which deforms in response to reception of a voltage, an electrode made of a conductive material and formed on a surface of the actuator main body to apply the voltage, and an insulating film formed on a surface of the electrode.

DESCRIPTION OF THE PREFERRED EMBODIMENT

The present invention will be described below in detail with reference to the accompanying drawings.

Figure 1:
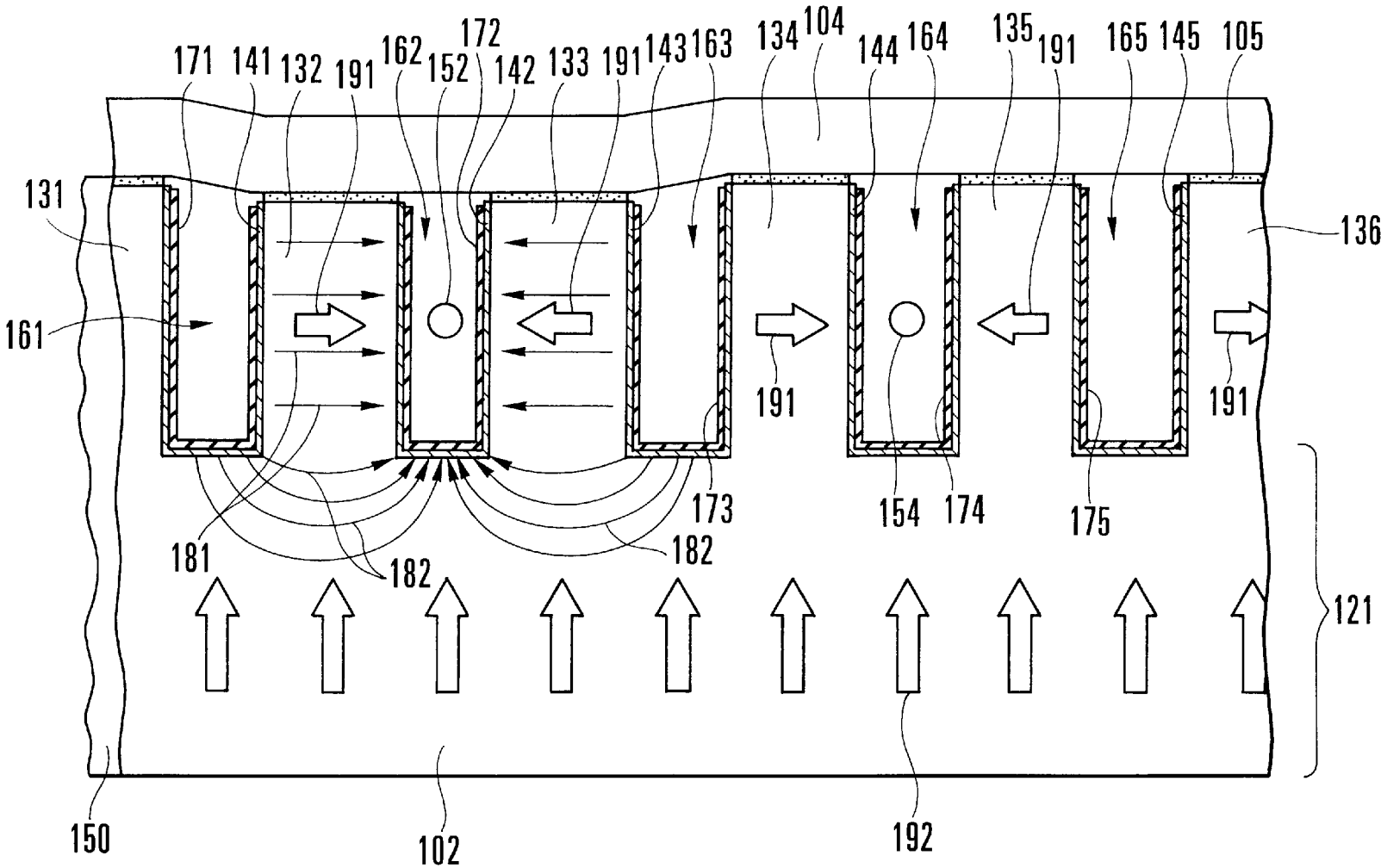
FIG. 1 is a sectional view of an ink jet head according to an embodiment of the present invention.

FIG. 1 shows an ink jet head according to an embodiment of the present invention. For the illustrative convenience, the hatched portion indicating a section is partially omitted. In FIG. 1, grooves are formed in the upper surface of a base plate 102 consisting of a piezoelectric material to form long groove-like channels 161 to 165 partitioned by partition walls 131 to 136. Electrodes 141 to 145 of a titanium film or a chromium film are formed on the inner walls and bottom surfaces of the channels 161 to 165, respectively, by sputtering or deposition. The base plate 102 after electrode formation is left to stand in air, thereby forming insulating native oxide films 171 to 175 (to be referred to as insulating oxide films hereinafter) on the electrodes 141 to 145, respectively.

A nozzle plate 150 forming one end face of each of the channels 162 and 164 along the longitudinal direction has nozzle holes 152 and 154. The channels 162 and 164 serve as ink channels while the channels 161, 163, and 165 are dummy channels.

The upper opening portions of the channels 161 to 165 are covered with a cover 104 fixed to the base plate 102 with adhesive portions 105. Each of the ink channels 162 and 164 forms an ink chamber together with the cover 104 and the nozzle plate 150. The other end face of each of the ink channels 162 and 164 constituting the ink chambers along the longitudinal direction is connected to a common ink reservoir (not shown), so the ink channels 62 and 64 are filled with ink.

In this arrangement, in the partition walls 132 to 135 on both sides of the ink channels 162 and 164, polarizations 191 are formed in advance toward the ink channels in the direction of thickness of partition walls (critical state). In addition, a polarization 192 is formed in the base plate 2 in the direction of thickness toward the ink channels in advance.

When a negative potential with respect to that at the electrodes 141 and 143 is applied to the electrode 142, the partition walls 132 and 133 deform in the expansion/contraction mode due to interaction between lines of electric force 181 and the polarization 191. The width and height of the ink channel 162 reduce in accordance with deformation of the partition walls 132 and 133. Since the sectional area of the ink channel 162 reduces, an ink droplet is ejected from the nozzle hole 152. The bottom portion of the ink channel 162 of the base plate 102 also deforms in the expansion/contraction mode due to interaction between lines of electric force 182 and the polarization 192, so the channel bottom portion becomes narrow.

As described above, the ink droplet ejection performance is determined by deformation of the partition walls 132 to 135 and the bottom portions of the ink channels 162 and 164. The same operation as described above is also performed in the ink channel 164 and the partition walls 134 and 135.

When ink is to be ejected from the nozzle hole 152 but not from the nozzle hole 154, a negative potential with respect to that at the electrodes 141 and 143 is applied to the electrode 142 while the same potential as that at the electrodes 143 and 145 is applied to the electrode 144. In this case, the electrode 142 has a negative potential with respect to the electrode 144.

The ink channels 162 and 164 are connected to the common ink reservoir (not shown), as described above. However, the electrode 142 of the ink channel 162 is insulated from the ink by the insulating oxide film 172. The electrode 144 of the ink channel 164 is also insulated from the ink by the insulating oxide film 174. Therefore, formation of a current leakage path, electrode 144→ink channel 164→ink reservoir→ink channel 162→electrode 142, is inhibited by the insulating oxide films 172 and 174.

With this arrangement, the ink is not electrolyzed at the electrodes 142 and 144, and bubble formation is prevented. For this reason, the ink channels 162 and 164 are prevented from being filled with bubbles, and the ink is stably ejected from the nozzle holes 152 and 154.

Connection between the electrodes 141 to 145 and a driving circuit (not shown) will be described next. The electrodes 141 to 145 are connected to the driving circuit by wire bonding. More specifically, a gold wire or an aluminum wire is pressed against the electrodes 141 to 145 using a tool called a capillary or wedge while being applied with an ultrasonic vibration. At this time, fresh surfaces are formed by destroying the insulating oxide films 171 to 175 on the electrode surfaces to form a conductive alloy, thereby realizing electrical connection.

Conductive members of gold, copper, nickel, or solder are formed at the connection portions between the electrodes 141 to 145 and the bonding wire by plating, deposition, or sputtering. With this process, the bonding wire can be easily connected using solder bumps or conductive adhesive portions.

Figure 2:
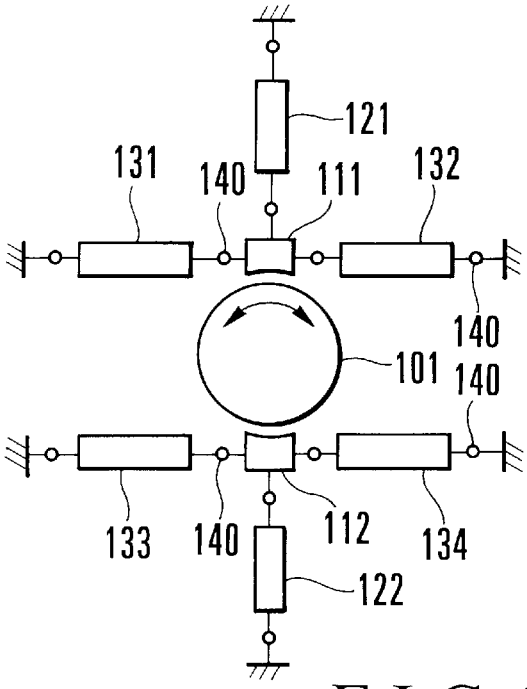
FIG. 2 is a view showing a state wherein a solid-state actuator shown in FIG. 1 is applied to an inchworm fine adjustment apparatus.

FIG. 2 shows a state wherein the solid-state actuator according to the present invention is applied to an inchworm fine adjustment apparatus.

In FIG. 2, a rotor 101 is supported to freely pivot clockwise and counterclockwise. Drivers 111 and 112 are arranged close to the outer side surface of the rotor 101 to oppose each other. The drivers 111 and 112 are supported to freely contact the outer side surface of the rotor 101. When the drivers 111 and 112 are brought into contact with the outer side surface of the rotor 101, the rotor 101 is clamped by the frictional force.

Each of supports 121 and 122 is constituted by the solid-state actuator (piezoelectric material) shown in FIG. 1. The supports 121 and 122 expand to bring the drivers 111 and 112 into contact with the rotor 101. Each of moving elements 131 to 134 is constituted by the solid-state actuator (piezoelectric material) shown in FIG. 1. The moving elements 131 to 134 expand to apply a pivotal force in the tangential direction of the rotor 101 clamped by the drivers 111 and 112.

As described above, insulating oxide films are formed on the electrode surfaces of the supports 121 and 122 and the moving elements 131 to 134. When the supports 121 and 122 and the moving elements 131 to 134 expand, hinges 140 prevent destruction of other supports or moving elements perpendicular to the expanded supports or moving elements due to the shearing force.

The operation of the fine adjustment apparatus having the above arrangement will be described next with reference to FIGS. 3A to 3D. In FIGS. 3A to 3D, the expanded supports 121 and 122 and the moving elements 131 to 134 are illustrated solid, and the moving directions of the drivers 111 and 112 are indicated by directions on the figures.

Figure 3A:
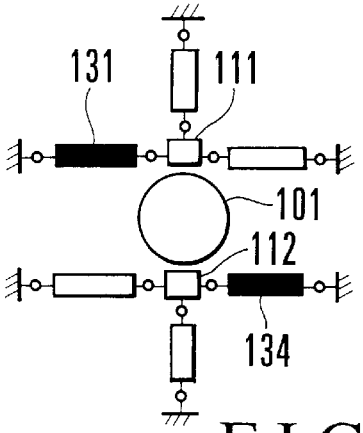
FIGS. 3A to 3D are explanatory views of the operation of the inchworm fine adjustment apparatus shown in FIG. 2.
Figure 3B:
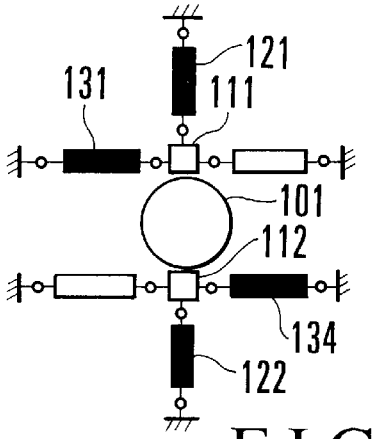

Referring to FIG. 3A, the moving elements 131 and 134 expand to move the driver 111 to the right side and the driver 112 to the left side. In this state, when the supports 121 and 122 expand, as shown in FIG. 3B, the drivers 111 and 112 are brought into contact with the outer side surface of the rotor 101 to clamp the rotor 101.

Figure 3C:
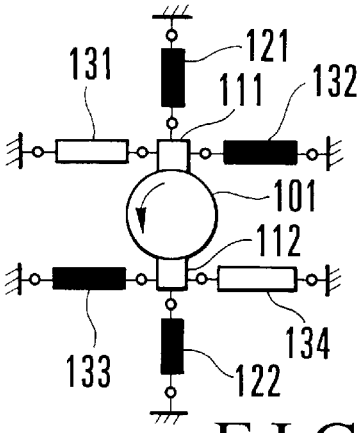
Figure 3D:
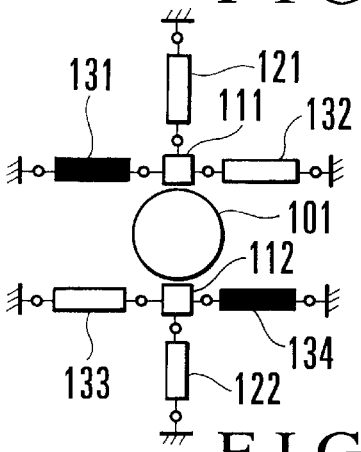
Figure 4:
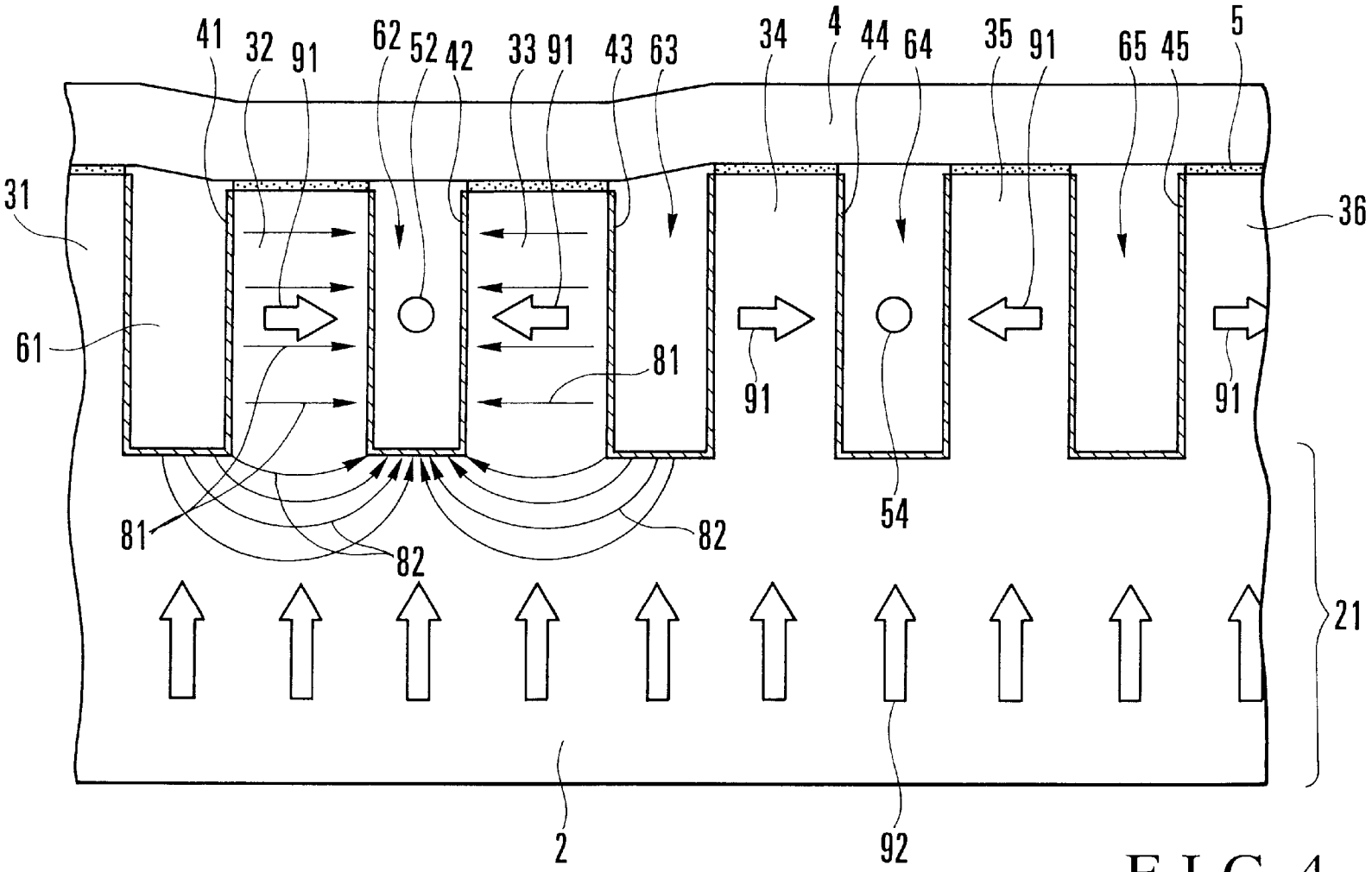
FIG. 4 PRIOR ART
FIG. 4 is a sectional view of a conventional ink jet head.

Next, as shown in FIG. 3C, the moving elements 132 and 133 expand, and simultaneously, the moving elements 131 and 134 contract. Since the driver 111 moves to the left side, and the driver 112 moves to the right side, the rotor 101 pivots counterclockwise by a very small amount. Next, in FIG. 3D, by contracting the supports 121 and 122, the drivers 111 and 112 are separated from the outer side surface of the rotor 101. After this, when the moving elements 131 and 134 expand again to move the driver 111 to the right side and the driver 112 to the left side, the state shown in FIG. 3A is restored. By repeating the above operation, the rotor 101 very slowly and accurately rotates counterclockwise.

When the fine adjustment apparatus having the above arrangement is used in the outer space, under a low atmospheric pressure, or in deep sea, air discharge in the space or under the low atmospheric pressure is prevented, or current leakage via seawater in deep sea is prevented because the insulating oxide films are formed on the electrode surfaces of the supports 121 and 122 and the moving elements 131 to 134.

In this embodiment, the solid-state actuator of a piezoelectric material is used as the base plate 102 of an ink jet head or for an inchworm fine adjustment apparatus. However, the present invention is not limited to this. The solid-state actuator may be used for, e.g., an ultrasonic motor. Even when the solid-state actuator is used as a stand-alone unit, the same function and effect as described above can be obtained.

The solid-state actuator uses a piezoelectric material. However, the present invention is not limited to this. An electrostrictive material may be used. Any material can be used as far as it deforms in response to reception of a voltage.

As has been described above, according to the present invention, since the electrode surfaces of the solid-state actuator are coated with an insulating material, the operation disabled state due to current leakage or air discharge can be avoided.

In addition, since the electrode surfaces exposed to the ink channels of the ink jet head are coated with an insulating material, bubble formation due to current leakage is prevented. Therefore, the ink ejection disabled state due to bubble formation can be prevented.

Furthermore, since a conductive material such as titanium or chromium is used for electrodes, and a native oxide film formed on the surface of the conductive material is used as an insulating layer, a reliable insulating film can be obtained. In this case, the process of coating the electrodes with an insulating material can be omitted.

What is claimed is:

1. An ink jet head comprising:

a base plate constituted by a solid-state actuator which deforms in response to reception of a voltage;

a plurality of groove-like ink channels formed in a surface of said base plate to be parallel to each other, said ink channels being filled with ink to form ink chambers;

an electrode made of a conductive material and formed on an inner surface of each of said ink channels to apply the voltage;

a nozzle hole formed in one end face of said ink channel to inject the ink, the end face being perpendicular to a direction of grooves of said ink channels; and an insulating film formed on a surface of said electrode;

wherein said insulating film formed on the surface of said electrode is destroyed by ultrasonic vibration to form a conductive alloy, thereby connecting a bonding wire to said electrode.

2. An ink jet head according to claim 1, wherein said electrode is made of one of titanium and chromium.

3. An ink jet head according to claim 1, wherein said insulating film is formed from a native oxide film of the electrode material formed on the surface of said electrode.

4. An ink jet head according to claim 1, wherein a conductive member for connecting a bonding wire is formed on the surface of said electrode using one of plating, deposition, and sputtering.

5. An ink jet head according to claim 1, wherein said actuator main body is made of a piezoelectric material.

6. An ink jet head according to claim 1, wherein said actuator main body is made of an electrostrictive material.

* * * * *